United States Patent [19]

Astier et al.

[11] Patent Number: 4,500,272

[45] Date of Patent: Feb. 19, 1985

[54] FLOATING CORE TRANSMISSION MEMBER FOR ULTRASONIC ASSISTANCE

[75] Inventors: Jean-Francois Astier, Boisseuil Feytiat; Louis Bessaguet, Limoges; Michel Laplanche, Feytiat, all of France

[73] Assignee: Legrand, Limoges, France

[21] Appl. No.: 491,445

[22] Filed: May 4, 1983

[30] Foreign Application Priority Data

May 4, 1982 [FR] France ..... 82 07701

[51] Int. Cl.[3] ..... B30B 11/02

[52] U.S. Cl. ..... 425/78; 173/162 R; 219/69 V; 425/174.2; 425/352

[58] Field of Search ..... 425/78, 79, 421, 456, 425/424, 432, 174.2; 264/23, 69, 71; 164/71.1; 403/225; 72/710; 219/69 V; 173/162 R

[56] References Cited

U.S. PATENT DOCUMENTS

| | | | |
|---|---|---|---|
| 2,549,642 | 4/1951 | Seelig | 425/421 |
| 2,725,692 | 12/1955 | Andreae | 403/225 |
| 2,747,231 | 5/1956 | Reinhardt | 264/23 |
| 2,909,826 | 10/1959 | McElroy | 425/421 |
| 3,071,809 | 1/1963 | Lerch | 264/23 |
| 3,635,609 | 1/1972 | Balamuth | 425/456 |
| 4,169,984 | 10/1979 | Parisi | 310/323 |
| 4,404,449 | 9/1983 | Astier et al. | 219/69 V |

FOREIGN PATENT DOCUMENTS

| | | | |
|---|---|---|---|
| 1599285 | 8/1970 | France . | |
| 450610 | 5/1975 | U.S.S.R. | 72/710 |

*Primary Examiner*—J. Howard Flint, Jr.
*Attorney, Agent, or Firm*—Charles A. Brown

[57] ABSTRACT

A transmission member of the kind comprising a floating core free to move in all directions within a casing, the floating core comprising at least two arms disposed at an angle to one another, one for supporting a driven member, the other for actuation by a driving member, and the casing comprising an internal housing with a configuration which duplicates that of the floating core. Between the floating core and the walls of the internal housing is disposed there is disposed an insulating layer of a solid elastic material. Use of the transmission member is directed, in particular, to ultrasonic assistance in compacting or drawing.

19 Claims, 9 Drawing Figures

FLOATING CORE TRANSMISSION MEMBER FOR ULTRASONIC ASSISTANCE

In French Patent Application No. 81 03511 filed Feb. 23, 1981, from which U.S. Pat. No. 4,404,449 claims priority, there is described a transmission member, or bearing, which, designed to be disposed between a first member, referred to for convenience as the driving member, and a second member, referred to for convenience as the driven member, generally comprises a floating core free to move in all directions within a casing, said core comprising at least two arms at an angle to one another which separately project externally of said casing, one for the driving member and the other for the driven member, and said casing comprising an internal housing with a configuration which replicates that of said core.

In a transmission member of this kind, the floating core in practice forms the transmission member proper, or transmitter, since it is to it that are coupled the driving and driven members, while the casing in which the floating core is mounted provides for attachment of the whole to a supporting assembly of any kind, such as the frame of a machine, for example, and its correct positioning relative to the latter.

In the aforementioned French Patent Application, the application of a transmission member of this kind to a machine for electro-erosion machining is more particularly envisaged, the driving member then consisting of a mechanical vibration generator, in practice a transducer, itself coupled to a pulse generator, in practice of ultrasonic frequency, while the driven member consists either of the machining electrode utilized or of the workpiece.

Be this as it may, it is necessary to provide mechanical isolation of the floating core from the casing in which it is disposed, to avoid transmission to the frame of the machine concerned of the mechanical vibrations to which the floating core is subjected, and so to protect the frame and other component parts of the machine.

In the case of a machine for electro-erosion machining, it is also necessary that the floating core be electrically isolated from the casing in which it is disposed, for appropriate confinement of the voltage applied conjointly between the machining electrode utilized and the part to be machined.

In the aforementioned French patent application No. 81 03511, it is more specifically proposed to this end to introduce any suitable supporting fluid between the floating core and the casing in which it is disposed.

In practice, this consists of compressed air injected for this purpose into the corresponding housing in said casing.

An arrangement of this kind, which permits work of long duration, is entirely satisfactory and is particularly suitable for implementation of the transmission member concerned in an electro-chemical or electro-erosion machining machine.

However, by virtue of the continuous leakage of compressed air that it involves, it inevitably consumes energy over and above the relatively little energy required to excite the mechanical vibration generator utilized.

In at least some applications this kind of energy consumption, which is acceptable in electro-erosion and electro-chemical machining machines since in this case it constitutes a virtually negligible increase in energy relative to the total energy requirement and improves efficiency, is unacceptable.

A general object of the present invention is an arrangement enabling this consumption of energy to be eliminated and thus authorizing extension to such applications of the scope of application of the transmission member concerned.

More precisely, a first object of the invention is a transmission member adapted to be disposed between a first member, hereinafter referred to for convenience as the driving member, and a second member, hereinafter referred to for convenience as the driven member, of the kind comprising a floating core free to move in all directions within a casing, said core comprising at least two arms at an angle to one another which separately project externally of said casing, one for the driving member and the other for the driven member, and said casing comprising an internal housing with a configuration which replicates that of said core, this transmission member being generally characterized in that, between the floating core and the walls of the housing of the casing in which said floating core is disposed there is disposed an insulating layer of a solid elastic material.

This insulating layer, which ensures retention of the floating core in the casing in which it is disposed, conjointly provides, without consuming any energy, both mechanical and electrical isolation of the floating core from the casing.

By its very nature, it is relatively fragile, so that it is not possible to envisage its application to prolonged utilization of the transmission member concerned, as is the case, for example, in electro-erosion and electro-chemical machining machines.

On the other hand, it is perfectly suited to other applications.

This is the case with compacting and drawing in particular.

At present, the compacting of products of all kinds, for example peat to constitute pellets usable in place of metallurgical coke, any other ore, metal turnings and ceramic powder for the manufacture of articles of all kinds, is usually carried out using a compacting device, in practice forming part of a press and generally comprising, for the purposes of operating in the internal space of a container adapted to contain the product to be compacted, a pressure member mounted movably relative to a fixed support member, a pressure member of this kind consisting, for example, of the plate or piston of a press of this kind and a support member of this kind consisting of the working table or frame of the latter.

Compacting in this way is not without its problems.

First of all, the pressure which can be applied to the product to be compacted is limited, as a result of which the product features cracks or stratification defects prejudicial to its homogeneity, such stratification defects being due to the fact that, when a press operates at high pressure, its pressure member inevitably moves in a discontinuous manner, in steps, rather than in a continuous manner.

By virtue of such limitation in respect of the compacting pressure applied to them, the products concerned do not always have the ideal density.

Also, extracting them from the container in which they have been compacted is sometimes difficult because, when the pressure of the press utilized is released, the container tends to contract around the product and grip it. Because of this, it is not unusual for a product of this kind to rupture on extraction from the container, especially in corner areas, this in practice leading to non-negligible reject rates.

Application of the transmission member in accordance with the invention to such compacting systems, rendered possible by the fact that, in the usual manner, the latter operate, not continuously, but rather intermittently, between consecutive releasings of the pressure, generally permits, without significant additional consumption of energy, facilitation of the required compacting and improvement of the results thereof.

In this connection, another object of the present invention consists in a compacting device of the kind comprising, to operate within the internal space of at least one container adapted to contain the product to be compacted, a pressure member mounted movably relative to a fixed support member, this compacting device being characterized in that it further comprises at least one transmission member in accordance with the invention, the casing of which is coupled to any one of the pressure members or support members and the floating core of which carries transversely and by means of an arm at least one vibration generator forming the driving member, whereas one of the other arms of said floating core, forming the driven member, is adapted to operate within the internal space of the container concerned, so that there may be applied simultaneously to the product present in the latter on the one hand a compacting action and, on the other hand, mechanical vibrations parallel to the latter, and in practice of ultrasonic frequency.

Experience has shown that it is possible, by virtue of superimposition in accordance with the invention of mechanical vibrations of this kind on the compacting action, to significantly increase the pressure utilized during such compacting action, without risk of any cracking occurring.

In practice, all other conditions being comparable, this pressure can more often than not be increased by a factor of three relative to the pressure usually utilized.

Moreover, the mechanical vibrations which may be applied in accordance with the invention to the compacted product after compacting offer the advantage of facilitating the extraction of the product from the container gripping it.

Such extraction can thus in most cases be effected without risk of destruction or damage and the reject rate is advantageously reduced commensurately.

In other words, the transmission member in accordance with the invention permits, with advantage, vibrational assistance to be associated with compacting, in practice vibrational assistance at ultrasonic frequencies.

The same applies to drawing.

Drawing is generally practised by utilizing a device comprising a die through the aperture of which the product to be drawn may be engaged and drawn.

A further object of the present invention is a drawing device of this kind characterized in that it further comprises a transmission member in accordance with the invention, the floating core of said transmission member carrying transversely, by means of an arm, a vibration generator forming the driving member and, by means of another arm, the die, forming the driven member, and having in line with the aperture of the latter a hole through which can pass the product to be drawn, so that there may be applied simultaneously to the latter on the one hand a drawing action and, on the other hand, mechanical vibrations parallel to the latter.

As previously, it is a matter in practice of vibrations at ultrasonic frequency.

It is already known to provide ultrasonic assistance in drawing through the application of vibration to a die.

However, in a first embodiment of this kind known at present, the corresponding vibration generators being disposed radially around the die, the assistance is implemented radially, that is to say transversely relative to the drawing direction.

Its effectiveness is thereby reduced.

In another embodiment also known at present, the vibration generator is disposed on the axis of the die, in line with the latter, so that the ultrasonic assistance applied is in fact parallel to the drawing direction.

However, the product to be drawn must in this case also pass axially through the vibration generator, which inevitably introduces limitations in practicable embodiments, by virtue of the resulting complexity of a vibration generator of this kind.

By virtue of the transmission member in accordance with the invention, this difficulty is easily overcome, the vibration generator being disposed transversely, offset from the hole through which the product to be drawn must pass.

The characteristics and advantages of the invention will moreover emerge from the following description given by way of example and with reference to the accompanying schematic drawings, in which.

Figure 1:
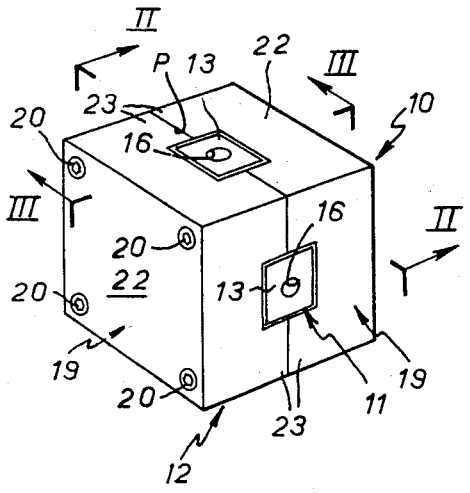
FIG. 1 is a perspective view of a transmission member in accordance with the invention.
Figure 2:
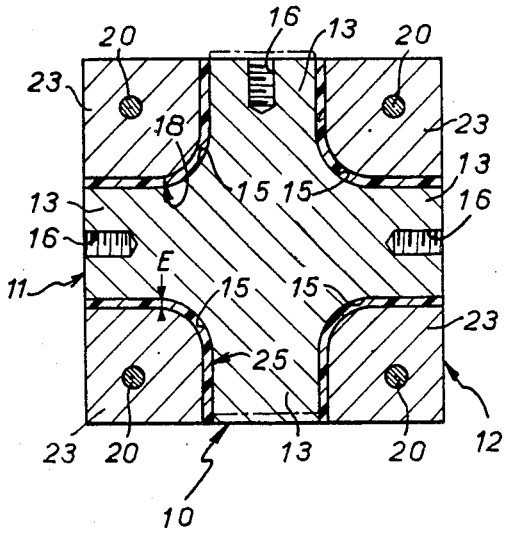
FIGS. 2 and 3 are sectional views on a larger scale taken generally on the lines II—II and III—III, respectively, in FIG. 1.
Figure 3:
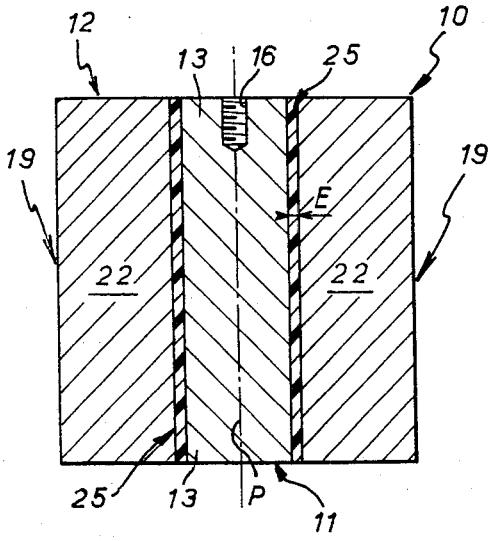

As shown in FIGS. 1 to 3, the transmission member 10 in accordance with the invention generally comprises, in a manner known per se, a floating core 11 mounted free to move in all directions in a casing 12.

Core 11 comprises at least two arms 13 at an angle to one another which separately project externally of casing 12.

In the embodiment shown, core 11 in practice comprises four arms 13 which are orthogonal in pairs, so that its general configuration is cruciform.

These arms 13 are joined to one another with large radii 15 and, in the embodiment shown in full line in FIG. 2, are all of substantially the same length; starting from their radii 15, their lateral flanks are plane and orthogonal in pairs.

At their termination externally of casing 12, each of arms 13 has a quadrangular transverse cross-section, for example and as shown, square, and, beginning from a cross-section of this kind, at least some of them have an axial threaded hole 16 to permit a member of any kind to be coupled thereto, as will emerge hereinafter.

Transversely, the core 11 thus constituted has the same thickness at all points, by virtue of which a core 11 of this kind may be very simply manufactured by appropriately cutting out a simple plate, a simple metal plate, for example.

The casing 12, which has a generally parallepiped-shaped external configuration, for example and as shown, cubic, comprises an internal housing 18 for the core 11 with a configuration which overall replicates that of said core 11.

In the embodiment shown, this casing 12 consists of two shells 19 which are in generally face-to-face relationship with one another along a joining plane P which forms, for the core 11, a median plane passing through the axis of its arms 13, and which are suitably attached to one another, for example and as shown by screws 20 disposed at their corners perpendicularly to said joining plane P.

Thus, in the embodiment shown, each of shells 19 generally consists, on the one hand of a baseplate 22 parallel to the joining plate P, and on the other hand of four bosses 23 which project towards the other shell 19 at the corners of said baseplate 22, each extending to half the thickness of the core 11, between the arms 13 of the latter.

It is in these bosses 23 that the screws 20 are in practice located.

Like the core 11, the casing 12 thus constituted may be of metal, for example.

In accordance with the invention, between the core 11 and the walls of housing 18 of casing 12 in which said core 11 is disposed there is disposed an insulating layer 25 made from a solid elastic material.

This insulating layer 25 extends over the walls of each of the bosses 23 of each of the shells 19 constituting the casing 12 and over the part of the baseplate 22 of a shell of this kind extending between said bosses 23.

It thus extends completely around the core 11, except for the transverse end cross-sections of the arms 13 of the latter.

In other words, the core 11 is embedded in the insulating layer 25 with the exception of the transverse end cross-section of its arms 13, and it is through the intermediary of this insulating layer 25 that it is mounted floating fashion in the casing 12, in view of the elastic composition of the insulating layer 25.

The insulating layer 25, which preferably but not necessarily adheres intimately to the core 11 and to the corresponding walls of the housing 18 of the casing 12, may be made from any suitable elastomer.

It may be a synthetic elastomer, for example a polyurethane or silicone type resin, or any form of natural rubber.

For preference, and as shown, the insulating layer 25 is of substantially uniform thickness E all around the core 11, both over the bosses 23 of the shells 19 of the casing 12 (FIG. 2) and over the baseplate 22 of the shells 19 (FIG. 3).

This thickness is preferably sufficient to ensure under proper conditions the necessary filtration of mechanical vibrations, without being too great in order to avoid being the site of excessive temperature rise in service by virtue of these mechanical vibrations.

The thickness E of the insulating layer 25 is comprised between 0.5 mm and 10 mm, for example.

Be this as it may, cooling means may if necessary be associated with the casing 12 and, for example, passageways may be formed inside the latter for the circulation of any suitable cooling fluid, and/or sprinkler means may be provided outside it (not shown in the figures).

As an alternative and/or conjointly, the insulating layer 25 may be charged with a mineral or other material able to improve the diffusion of heat and so improve cooling of the insulating layer 25.

Figure 4:
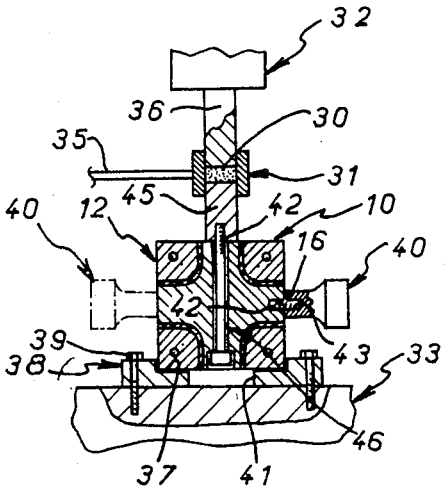
FIG. 4 is a cross-sectional view with other parts in elevation illustrating the application of the transmission member to compacting, in a first embodiment of said transmission member.

FIG. 4 illustrates the application of the transmission member 10 in accordance with the invention to a compacting device, for ultrasonic assistance in the compacting of any given material 30, for example any powder or chipped material.

Generally speaking, and in a manner known per se, the compacting device used for this purpose comprises, to operate within the internal space of a container 31 adapted to contain the product 30 to be compacted, a pressure member 32 mounted movably relative to a fixed support member 33.

As a compacting device of this kind is well known per se, it will not be described in detail here.

It is sufficient to specify that the pressure member 32 and the support member 33 form parts, for example, of a hydraulic press, of which the pressure member 32 constitutes the piston or is carried by the piston, and of which the support member 33 constitutes the worktable or is carried by the worktable.

Similarly, the container 31 utilized will not be described in detail here.

In the embodiment shown in FIG. 4, it is a tubular container open at each end, and this tubular container is fastened to any suitable support 35, a beam, for example, itself supported by the fixed support member 33.

To operate within the internal space of a container 31 of this kind, in the embodiment shown in FIG. 4 the pressure member 32 has a punch member 36 which is of complementary cross-section to that of said container 31 and is engaged in the latter at its free end.

In accordance with the invention, the compacting device utilized further comprises at least one transmission member 10 of the kind described hereinabove with reference to FIGS. 1 to 3.

In the embodiment shown in FIG. 4, the casing 12 of this transmission member 10 is coupled to the support member 33.

In practice, in this embodiment, it is merely supported on this support member 33.

For example, and as shown, it may be partially engaged by one of its faces in a recess 37 provided for this purpose in a baseplate 38 attached by screws 39 to the support member 33, with its core 11 directed towards the container 31 through one of its arms 13.

Preferably, and as shown, the baseplate 38 comprises, in line with the arm 13 of the core 11 opposite to that of arms 13 of this core 11 thus directed towards the container 31, an opening 41 to avoid any contact between the core 11 and the support member 33.

As an alternative, and as shown schematically in FIG. 2, to avoid any contact with the baseplate 38, the relevant arm 13 of the core 11 is recessed behind the corresponding external termination of the housing 18 of the casing 12.

Be this as it may, the floating core 11 of the transmission member 10 utilized in accordance with the invention carries transversely, by means of one at least of its lateral arms 13 relative to the container 31, a vibration generator 40 forming a driving member.

In the embodiment shown in FIG. 4, only one such vibration generator 40 is provided, shown in full line on one of the lateral arms 13 of the core 11. However, as shown in chain-dotted line in FIG. 4, a vibration generator 40 could also be provided on the other of said lateral arms 13 of the core 11.

A vibration generator 40 of this kind does not constitute part of the present invention, and so will not be described in detail here.

It is sufficient to specify that it associates a transducer and a pulse generator and that it is capable of producing mechanical vibrations at frequencies which are in practice ultrasonic.

This vibration generator 40 may, for example, be of the type marketed by the company Branson and have a power rating of between 0.5 and 5 kW, for example.

It is mounted by any appropriate means on the relevant arm 13 of the floating core 11.

For example, and as shown, there is utilized for this purpose a captive bolt 42 which is screwed into the threaded hole 16 provided for this purpose in an arm 13 of the floating core 11 and which is also screwed into a threaded hole 43 provided for this purpose in the free end of the vibration generator 40 utilized.

By means of that of its arms 13 which is directed towards the container 31, forming the driving member, the floating core 11 of the transmission member 10 utilized in accordance with the invention is able to operate, like the punch 36 of the pressure member 32, within the internal space of said container 31.

Thus this arm 13 could intervene directly in this container 31, being integrally extended to a sufficient length for this purpose.

However, it is preferable, in order to render the transmission member 10 general-purpose, for the relevant arm 13 of the floating core 11 to carry an extension 45 adapted to operate within the internal space of the container 31, the length of which is conditioned by the wavelength of the vibrations produced by the vibration generator 40, this length being, for example, equal to half this wavelength or a multiple of the latter. It is complementary with said container 31, at least at its free end, and engaged in the latter.

In the embodiment shown, this extension 45 is attached to the relevant arm 13 of the floating core 11 by a screw 46 which passes through the whole of said floating core 11 and the head of which butts up against the base of a recess formed for this purpose in the transverse end cross-section of the opposite arm 13, so as to not project beyond the latter.

As an alternative, it could be attached by a captive bolt, in the same way as the mechanical vibration generator 40.

As will be noted, the container 31 is closed at one end by the punch 36 carried by the pressure member 32 and at the other end by the extension 45 carried by the corresponding arm 13 of the floating core 11 of the transmission member 10 utilized in accordance with the invention.

During compacting by the pressure member 32 of the product 30 confined in the container 31, there is applied simultaneously to the product 30 on the one hand the compacting action due to the pressure member 32 and, on the other hand, the mechanical vibrations produced by the vibration generator 40.

The amplitude of these mechanical vibrations is of the order of 10 microns or less, for example.

In spite of the bend between the corresponding arms 13 of the floating core 11 in line with the container 31, the vibrations applied to the product 30 to be compacted contained in the container 31 are applied parallel to the compacting action to which the product is conjointly subjected.

Whatever the direction in which these vibrations are emitted, they are propagated parallel to the axis of the arms which transmit them.

By virtue of the ultrasonic assistance thus associated with the compacting in progress, the compacting is improved and the pressure which can be utilized without any cracking defects occurring is advantageously increased, as mentioned hereinabove.

During compacting, the insulating layer 25 in accordance with the invention mechanically isolates the core 11 of the transmission member 10 utilized from the casing 12 of the latter, and thus from the support member 33 of the corresponding compacting device, in spite of the local crushing to which it is subjected by virtue of the compacting action exercised.

In the case where no recess or opening 41 is formed in the baseplate 48, the end transverse cross-section of the relevant arm 13 of the core 11 is recessed behind the corresponding external termination of the housing 18 of the casing 12, and said core 11 at worst contacts this baseplate 38 only in the final stage of compacting, after local crushing of the insulating layer 25, which avoids excessively rapid wear of this core 11 and the baseplate 38, or of the support member 33 if the casing 12 bears directly on the latter.

However, the arrangement is preferably such that the core 11 never comes into contact with the baseplate 38 or with the support member 33 if the casing 12 bears directly on the latter, the pressure exerted being in practice limited by the elastic resistance to compression of the insulating layer 25 prior to permanent deformation and/or creep.

In any event, the degree of crushing of the insulating layer 25 is very limited.

Additionally, the insulating layer 25 in accordance with the invention also offers the advantage of protecting the core 11 from any soiling, and opposes the ingress of any foreign matter between it and the casing 12.

After compacting, the vibration generator 40 may with advantage be further utilized to facilitate the extraction of the compacted product from the container 31.

Figure 5:
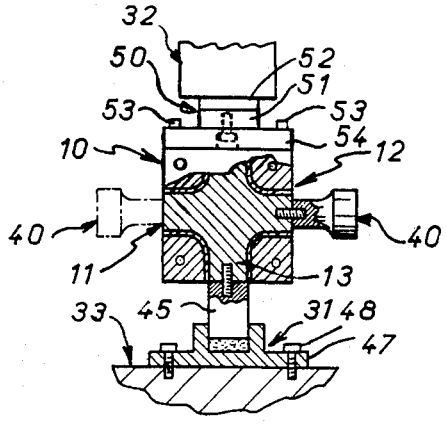
FIGS. 5, 6 and 7 are views generally similar to that of FIG. 4 and each figure relating to a respective variant embodiment of the transmission member.

In the embodiment shown in FIG. 5, the container 31 is attached to the support member 33, whereas the casing 12 of the transmission member 10 utilized is coupled to the pressure member 32.

For example, and as shown, the container 31 may be attached to a baseplate 47 attached by screws 48 to the support member 33, the arm 13 of the floating core 11 directed towards this container 31 then carrying, as previously and to operate within the latter, an extension 45.

In this case, the container 31 is closed at one end by the baseplate 47 which carries it and at the other end by the extension 45 of the corresponding arm 13 of the floating core 11.

Conjointly, the casing 12 of the transmission member 10 may be attached to the pressure member 32 by any appropriate means.

It may, for example, be coupled to it through the intermediary of an adoptor or coupling device 50 of the type described in U.S. Pat. No. 3,271,848, such as those marketed commercially under the designation "IMEA".

An adaptor or coupling device of this kind will not be described in detail here.

It is sufficient to indicate that it is formed of two parts 51, 52, one male and the other female, adapted to be fastened to one another in a removable manner by means of an eccentric pin.

By means of an intermediate plate 54 which is attached by screws 53 to the casing 12, the latter is attached to the male part 51 of the adaptor or coupling member 50, this intermediate plate 54 being coupled to said male part 51 by screws 53 disposed in recesses formed for this purpose in its bottom surface, whereas and conjointly the corresponding female part 52 is coupled to the pressure member 32 by screws which are not visible in the figures.

In the foregoing description, only one transmission member 10 is utilized, so that the ultrasonic assistance implemented is single-action.

As an alternative (FIG. 6), it may be double-action, two transmission members 10 being utilized, one coupled to the pressure member 32, using arrangements of the kind described with reference to FIG. 5, for example, and the other coupled to the support member 33, using arrangements of the kind described with reference to FIG. 4, for example.

In this case the container 31, which is of the kind described with reference to FIG. 4, for example, is closed at each end by a respective extension 45 carried by a respective arm 13 of the floating cores 11 of the corresponding transmission members 10.

Figure 7:
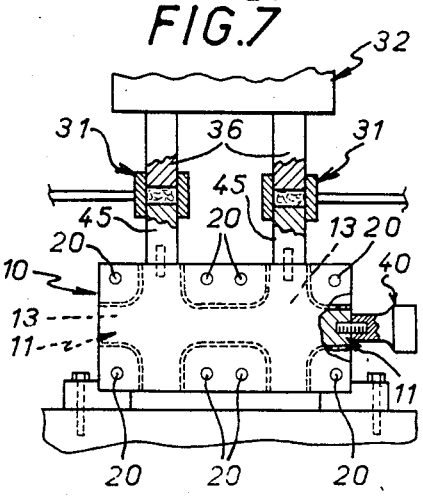

As shown in FIG. 7, two containers 31 may be utilized in parallel, for improved productivity; the floating core 11 of the corresponding transmission member 10 then has laterally, and transversely relative to an arm 31 carrying a vibration generator 40 and forming a driving member, two parallel arms 13 which each carry an extension 45 and each form a driven member, each individually operating within said containers 31.

In the embodiment shown in FIG. 7, the arrangements are generally of the kind described with reference to FIG. 4, but it will be obvious that for a double-action effect, they could be of the kind described with reference to FIG. 6.

Figure 6:
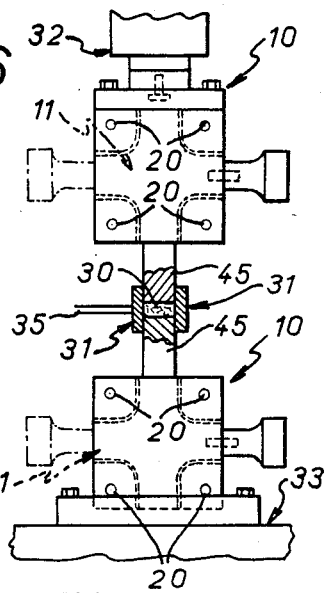

When, as shown schematically in FIGS. 5 and 6, two mechanical vibration generators 40 are utilized, one of them may be utilized as a sensor for monitoring the resultant ultrasonic energy and thus the effectiveness of the compacting action, and to condition thereby the power applied by the pressure member 32.

Figure 8:
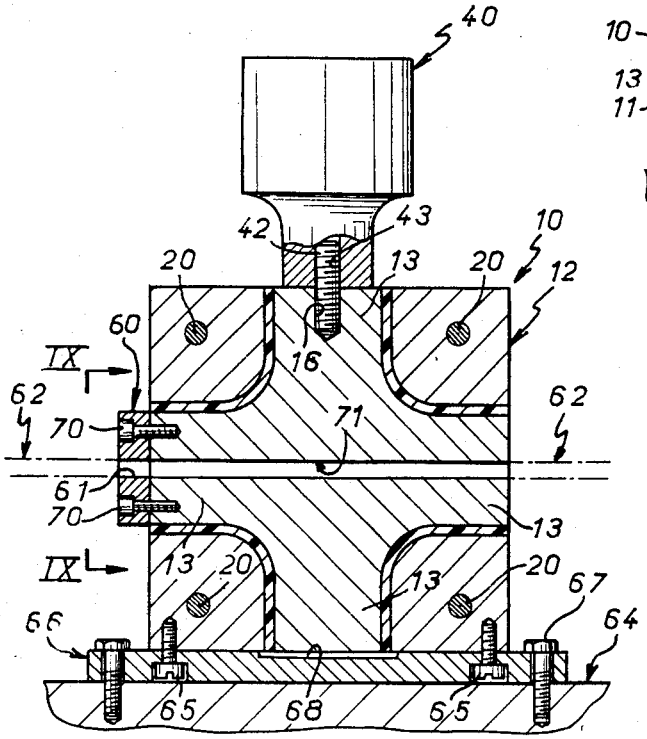
FIG. 8 is a view simlar on that of FIG. 4 to a larger scale and illustrating the application of the transmission member.
Figure 9:
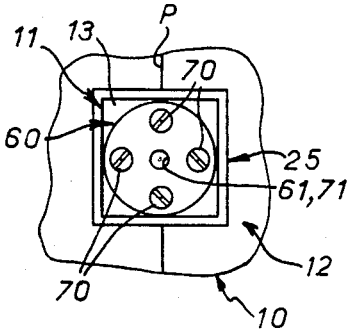
FIG. 9 is a partial side elevational view of the device shown in FIG. 8, on the line IX—IX in of FIG. 8.

FIGS. 8 and 9 illustrate the application of the transmission member in accordance with the invention to ultrasonic assistance in drawing.

The drawing device utilized to this end generally comprises, in a manner known per se, a die 60 through the aperture 61 in which the product 62 to be drawn may be engaged and drawn, as shown schematically in chain-dotted line in FIG. 8.

In accordance with the invention, this compacting device further comprises a transmission member 10 of the type described hereinabove with reference to FIGS. 1 to 3.

The casing 12 of this transmission member 10 is preferably, and as shown, coupled to any form of support 64.

For example, and as shown, it is attached by screws 65 to a baseplate 66 which is itself attached by screws 67 to the support 64.

As previously, the baseplate 66 preferably has a recess or opening 68 in line with the corresponding arm 13 of the floating core 11, to prevent any transmission of mechanical vibration to the support 64.

By that of its arms 13 which is opposite the support 64, the floating core 11 of the transmission member 10 utilized in accordance with the invention carries, transversely, a mechanical vibration generator 40 forming a driving member.

By another of its arms 13, forming a driven member, it carries the die 60, the latter being attached by screws 70 to the end of the arm in question, for example.

Also, in line with the aperture 61 in die 60 the floating core 11 of the transmission member utilized in accordance with the invention has, longitudinally, along the axis of its arm 13 carrying the die 60 and of the arm opposite same, a hole 71 through which the product 62 to be drawn can pass.

Thus there may be applied simultaneously to the product G2 on the one hand a drawing action and, on the other hand, mechanical vibrations which, as will be clear from the foregoing description, are advantageously applied parallel to said drawing action.

The drawing action is thus facilitated.

By way of non-limiting example only, it is specified that frequencies of 20 kHz and 40 kHz have proved satisfactory and that the length of the side of the casing utilized is for preference selected in consequence; however, to allow for the fact that the core is not of a simple geometric shape, this length is for preference less than a half-wavelength; it is 120 mm at 20 kHz or 60 mm at 40 kHz, for example, with respective core arm cross-sections of 40×40 mm and 20×20 mm.

It will be understood that the present invention is not limited to the embodiments described and shown, but rather encompasses all variants in execution.

In particular, the frequencies utilized are not necessarily ultrasonic, as lower frequencies can also prove satisfactory.

Also, to facilitate the attachment of any member to any of the arms of the floating core of the transmission member utilized, the end of this arm may if required project beyond the corresponding external termination of the housing of the casing, as shown schematically in chain-dotted line in FIG. 2 for one of the arms in question.

Further, the application of the invention is not necessarily limited to compacting and drawing only, but may also extend to other forms of mechanical treatment to be applied to products of all kinds.

We claim:

1. In a transmission member for ultrasonic vibrations said transmission member being of the type including a casing, a floating core free to move in all directions within said casing, said core having at least two arms disposed at an angle to one another, said at least two arms separately projecting towards the exterior of said casing, one of said arms having means for connection to an ultrasonic driving member and another of said arms having means for connection to a driven member, and said casing defining an internal housing having a configuration which corrresponds to that of the exterior of said core and being spaced from said core, an improvement comprising an insulating layer positioned between said floating core and walls of said internal housing in the casing in which said floating core is disposed, said insulating layer being formed of a solid elastic material filling said space in said casing between said casing and said core.

2. An improved transmission member according to claim 1, wherein said insulating layer is of substantially uniform thickness.

3. An improved transmission member according to claim 2, wherein the thickness of said insulating layer is between 0.5 mm and 10 mm.

4. An improved transmission member according to claim 1, wherein an end of at least one of said arms of said floating core projects outwradly beyond a corresponding part of said internal housing of said casing.

5. An improved transmission member according to claim 1, wherein an end of at least one of said arms of said floating core is recessed relative to a corresponding end of said internal housing of said casing.

6. A transmission member according to claim 1, wherein said transmission member is constructed to transmit vibrations between the driving member and the driven member in a range of frequencies between 20 kHz and 60 Khz.

7. A transmission member according to claim 3, wherein said transmission member is constructed to transmit vibrations between the driving member and the driven member in a range of frequencies between 20 kHz and 60 kHz.

8. An improved transmission member according to claim 1, wherein said elastic material is bonded to said core and said casing.

9. An improved transmission member according to claim 3, wherein said elastic material is bonded to said core and said casing.

10. A compacting device for compacting a product in a container, said compacting device comprising a pressure member for compacting the product in the container and being movable relative to a fixed support, a transmission member interposed between said pressure member and said fixed support, said transmission member comprising a casing a floating core housed within said casing, said casing being fixed to one of said pressure member and said fixed support, said core having at least two arms disposed at an angle to one another and projecting toward an exterior of said casing, one of said arms of said core being connected to an ultrasonic vibration generator, and another of said arms forming a driven member, said driven member being cooperable with said container for applying ultrasonic vibrations to the product to be compacted while said pressure member exerts a compacting action on the product, said compacting action and said high frequency vibrations being applied to the product to be compacted in parallel relation to each other.

11. A compacting device according to claim 10, wherein said insulating layer is of substantially uniform thickness.

12. A compacting device according to claim 10, wherein the thickness (E) of said insulating layer is between 0.5 mm and 10 mm.

13. A compacting device according to claim 10, wherein said insulating layer is of substantially uniform thickness and wherein the thickness (E) of said insulating layer is between 0.5 mm and 10 mm.

14. A compacting member according to claim 10, wherein said elastic material is bonded to both said core and said casing.

15. A transmission member according to claim 13, wherein said elastic material is bonded to both said core and said casing.

16. A compacting device according to claim 10, wherein said casing is affixed to said pressure member.

17. A compacting device according to claim 10, wherein said casing is affixed to said fixed support.

18. A compacting device according to claim 10, wherein said one arm of said floating core carries an extension having a length which is dependent on the wavelength of the mechanical vibrations utilized, the length of said extension being substantially equal to one half-wavelength or a multiple thereof.

19. A compacting device for compacting a product, said compacting device comprising a fixed support, a pressure member for compacting a product and being movable relative to said fixed support, a transmission member interposed between said pressure member and said fixed support, said transmission member comprising a casing, a floating core housed within said casing, said casing being fixed to one of said pressure member and said fixed support, said core having at least two arms disposed at an angle to one another and projecting toward an exterior of said casing, one of said arms of said core being connected to an ultrasonic vibration generator, and another of said arms forming a driven member, said driven member being operable to apply ultrasonic vibrations to a product to be compacted while said pressure member exerts a compacting action on such product, said compacting action and said high frequency vibrations being applied to a product to be compacted in parallel relation to each other, there being two of said vibration generators, a second of said vibration generators forming a sensor for determining the power applied by said pressure member.

* * * * *